US006380524B1

(12) United States Patent
Keller

(10) Patent No.: US 6,380,524 B1
(45) Date of Patent: Apr. 30, 2002

(54) MICROWAVABLE FOOD PACKAGE HAVING VALVE AND METHOD OF USE

(75) Inventor: Karl Keller, Chilewise 11, 8197 Rafz (CH)

(73) Assignee: Karl Keller, Rafz (CH)

( * ) Notice: Subject to any disclaimer, the term of this patent is extended or adjusted under 35 U.S.C. 154(b) by 0 days.

(21) Appl. No.: 09/635,197

(22) Filed: Aug. 9, 2000

(30) Foreign Application Priority Data

Aug. 9, 1999 (CH) ..... 1457/99

(51) Int. Cl.[7] ..... H05B 6/80; B65D 81/34

(52) U.S. Cl. ..... 219/725; 219/735; 99/DIG. 14; 426/118; 426/234; 220/367.1

(58) Field of Search ..... 219/735, 734, 219/725, 762; 426/113, 107, 118, 241, 234; 99/DIG. 14; 220/367.1, 745

(56) References Cited

U.S. PATENT DOCUMENTS

| | | | | |
|---|---|---|---|---|
| 2,850,391 | A | 9/1958 | Gunsberg | 426/113 |
| 3,432,087 | A | 3/1969 | Costello | 426/118 |
| 3,659,584 | A | 5/1972 | Doyle et al. | 126/369 |
| 3,672,907 | A | 6/1972 | Hudson | 99/1 |
| 3,716,180 | A | 2/1973 | Bemiss et al. | 279/0.3 |
| 3,799,427 | A | 3/1974 | Goglio | 229/62.5 |
| 3,854,023 | A | 12/1974 | Levinson | 219/10.55 |
| 3,949,934 | A | 4/1976 | Goglio | 229/62.5 |
| 4,141,487 | A | 2/1979 | Faust et al. | 229/43 |
| 4,210,674 | A | 7/1980 | Mitchell | 426/107 |
| 4,261,504 | A | 4/1981 | Cowan | 229/43 |
| 4,358,466 | A | 11/1982 | Stevenson | 426/106 |
| 4,404,241 | A | 9/1983 | Mueller et al. | 428/35 |
| 4,419,373 | A | 12/1983 | Oppermann | 426/234 |

(List continued on next page.)

FOREIGN PATENT DOCUMENTS

| | | | |
|---|---|---|---|
| DE | 19 03 048 | | 9/1969 |
| DE | 23 60 126 | | 6/1974 |
| DE | 25 49 855 | | 9/1977 |
| DE | 27 32 661 | | 2/1979 |
| DE | 31 25 496 | A1 | 1/1983 |
| DE | 41 22 077 | A1 | 1/1993 |
| EP | 0 069 264 | A1 | 1/1983 |
| EP | 0 149 695 | A1 | 7/1985 |
| EP | 0 198 362 | A2 | 10/1986 |
| EP | 0 218 419 | A1 | 4/1987 |
| EP | 0 303 428 | A2 | 2/1989 |
| EP | 0 462 767 | A2 | 6/1991 |
| EP | 0 478 812 | A1 | 4/1992 |
| EP | 0 597 741 | A1 | 5/1994 |
| EP | 0 659 657 | A1 | 6/1995 |
| EP | 0 795 482 | A2 | 9/1997 |
| JP | 63 307085 | | 12/1988 |
| NL | 9 301 592 | | 4/1995 |
| WO | WO 95/26912 | | 10/1995 |
| WO | WO 99/32372 | * | 7/1999 |

*Primary Examiner*—Philip H. Leung
(74) *Attorney, Agent, or Firm*—Morgan, Lewis & Bockius LLP

(57) ABSTRACT

The microwavable shipping and/or retail package described here for heating food includes a material suitable for use in a microwave oven. The food disposed in the package is preferably at least partially raw. Taking into account the water content of the food, enough liquid is present in the package for the food to be cooked in a steam atmosphere which develops in the package when heated in a microwave oven. The package has a one-way valve in a wall, which opens automatically to the outside when there is an internal excess pressure, then closes again automatically after the pressure drops, thus limiting and/or reducing the vapor pressure that develops in the package during heating in a microwave oven. The valve membrane may automatically open and automatically close until the membrane deforms during heating, thereby causing said valve to remain open.

21 Claims, 1 Drawing Sheet

U.S. PATENT DOCUMENTS 4,444,219 A 4/1984 Hollenstein ..... 137/246
4,490,597 A * 12/1984 Mengel ..... 219/735
4,529,089 A 7/1985 Gasbarra et al. ..... 206/525
4,574,174 A 3/1986 McGonigle ..... 219/10.55 M
4,640,838 A 2/1987 Isakson et al. ..... 426/107
4,653,661 A 3/1987 Buchner et al. ..... 220/209
4,746,019 A 5/1988 Prater ..... 206/625
4,786,513 A 11/1988 Monforton et al. ..... 426/107
4,834,554 A 5/1989 Stetler, Jr. et al. ..... 383/100
4,859,822 A 8/1989 Ragusa et al. ..... 219/10.55 E
4,865,854 A 9/1989 Larson ..... 426/107
4,961,944 A 10/1990 Matoba et al. ..... 426/107
4,987,280 A 1/1991 Kanafani et al. .... 219/10.55 M
5,263,777 A 11/1993 Domke ..... 383/103
5,326,176 A 7/1994 Domke ..... 383/103
5,388,910 A 2/1995 Koyanagi ..... 383/100
5,587,192 A 12/1996 Beizermann ..... 426/118
5,780,824 A * 7/1998 Matos ..... 219/735
5,806,703 A 9/1998 Grandi ..... 220/203.15
5,928,553 A * 7/1999 Toshima et al. ..... 219/735
5,974,686 A * 11/1999 Nmura et al. ..... 219/735
5,989,608 A * 11/1999 Mizuno ..... 426/118

MICROWAVABLE FOOD PACKAGE HAVING VALVE AND METHOD OF USE

TECHNICAL FIELD

The present invention relates to a shipping and/or retail package for and with food(s) that are intended for consumption while hot and are to be heated in the package according to the definition of the species of patent claim 1.

The present invention also relates to a method of preparing foods in a container in a microwave oven, where a steam buildup situation develops with an excess pressure in the container during heating due to the water content of the foods and the construction of the container.

STATE OF THE ART

A package and a cooking method of this type are known from International Patent No. WO 99/32373. In particular, fresh foods which are still raw can be cooked in just a few minutes in the known package by using this method, thus making it possible to achieve a quality that is impossible with traditional prepared dishes.

The valve plays an important role here. The valve is designed as one-way non-return valve and permits automatic venting of the foods before the actual preparation with an extremely low opening pressure of just a few millibar. At the same time, it ensures a hermetic seal by closing up again after each opening as soon as the internal excess pressure has dropped below a certain level.

International Patent No. WO 99/32373 describes a valve available under the brand name of WICOVALVE from Wipf AG at CH-8604 Volketswil. This valve was designed for prefilled bags of roasted coffee. The valve has a dimensionally stable valve body with a flat sealing face and a thin, flexible membrane in it. The membrane is wetted with some sealing oil. Because of this design, the valve seals well and it opens and closes within a relatively narrow tolerance. Thus, its opening pressure is only approx. 3 mbar. It closes again when the internal excess pressure has dropped to approx. 0.5 mbar. The valve also has a well-defined flow cross section. Because of these properties, the cooking results can be monitored and predicted with sufficient accuracy. Thus, for example, vegetables packaged in this type of package can be cooked precisely until they have reached an "al dente" condition.

The known package is preferably designed as a disposable package. In one embodiment, it consists of a flat shell made of a plastic material that is relatively thin but still has enough dimensional stability to withstand shipping and handling as well as the temperature and pressure stresses occurring during the steam buildup phase. The shell is covered with a transparent, flexible plastic film which is welded to the shell along its peripheral edge. The valve is preferably also incorporated into this cover film.

EXPLANATION OF THE INVENTION

The purpose of the present invention is to further improve the known package and the method associated with it. It has been found that a reduced pressure situation can under certain conditions occur in the package during cooling to the desired temperature for eating after being heated in a microwave oven in particular. In the case of packages with wall parts that are dimensionally stable although still relatively thin, such as the above-mentioned shell, this may lead to an unwanted deformation "into the negative." Due to the design of the valve according to the present invention so that it undergoes changes during heating of the foods in the package so that the valve can no longer close again, at least while the food is cooling to the temperature for consumption, the development of a reduced pressure in this phase is prevented. Of course, the valve may also undergo permanent changes, because its function is no longer needed after preparation of the food.

With a valve of the above-mentioned type, the desired change can occur in particular by selecting for the thin membrane a plastic material which undergoes deformation at the resulting temperature when the package is heated. However, this deformation should occur only at a temperature of at least approximately 50° C. or even 60° C., so the valve retains its function before the actual heating process, i.e., during shipping and storage of the package.

In order for the desired steam atmosphere to be able to develop in the package during heating, the foods should have a water content of at least 30%, preferably 40%. The foods are preferably preseasoned to their final taste, so that they are ready to eat immediately after heating in a microwave. The term "seasoning" should be understood to refer to the usual herbs, spices and flavorings as well as the addition of a small amount of herb butter, sauce or the like. Servings of meat or fish are preferably also coated with an emulsion of seasonings, an oil- or fat-based marinade or the like, additionally protecting the servings of meat or fish from becoming stringy in the microwave. Raw dough for a cake or the like may also be used, in which case it is then "steam-baked" so to speak in the steam atmosphere.

In another aspect, the present invention provides a method for heating a food product by microwave energy that includes the steps of providing a food product having a water content that enables steam pressure to develop during heating by microwave energy; disposing and sealing a food product in a microwavable shipping and/or retail package, the package comprising a container with a one-way valve mounted in a wall of the container, the valve having a flexible membrane; and heating the package by microwave energy, causing excess pressure to develop in the container, whereby the valve automatically opens and vents pressure to the outside and the valve automatically closes when the pressure drops, wherein the valve may automatically open and automatically close until the membrane deforms, thereby causing the valve to remain open.

Advantageous embodiments and refinements of this invention are characterized in the dependent claims.

BRIEF EXPLANATION OF THE FIGURES

The present invention will be explained in greater detail below on the basis of embodiments in conjunction with the drawings, which show.

METHODS OF CARRYING OUT THIS INVENTION

Figure 1:
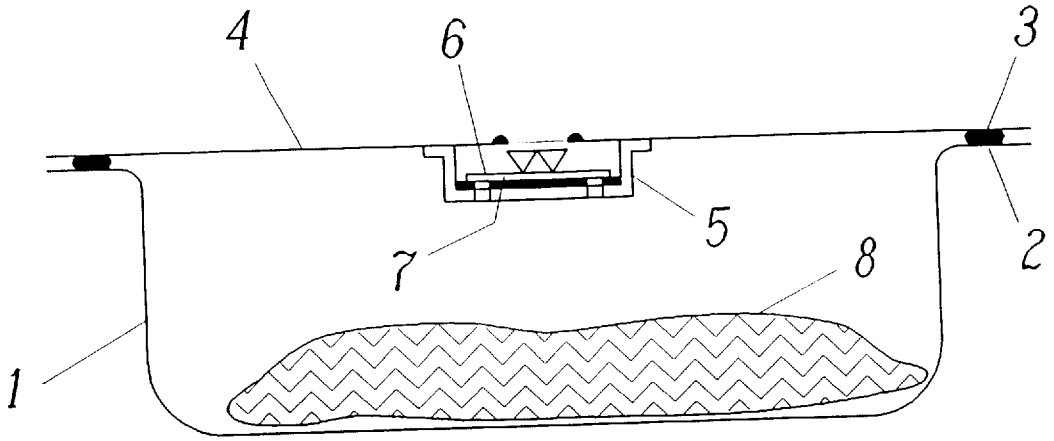
FIG. 1: an embodiment of a package according to the present invention, based on a shell.

The drawings show a shallow, deep-drawn shell with a rectangular, square or round basic outline, made of a thin plastic material. For example, polypropylene may be used for this purpose, preferably a blend of polypropylene monomer and copolymer in a ratio of approximately 90:10 to approximately 95:5. The wall thickness should be from approximately 600 μm to approximately 900 μm, but 900 μm guarantees a better fat stability. A cover film 4, preferably welded to the peripheral edge 2 of the shell 1 by means of a peripheral weld 3, may consist, for example, of 12 μm polyester welded to approximately 90 to 100 μm polypropylene monomer. A valve 5 of the type mentioned above, i.e., a WICOVALVE disposable non-return valve from the Wipf company, having a membrane 6 on the sealing face 7, is incorporated into the cover film 4. To make it easier to understand, the size of valve 5 and its thickness have been exaggerated in this drawing. In reality, the WICOVALVE valves from Wipf have a diameter of only approximately 1.5 cm and a thickness of approximately 3 mm. As mentioned above, a small amount of sealing oil is also present between membrane 6 and sealing face 7 of the WICOVALVE valve. A foodstuff 8 with a certain inherent water content, i.e., in the form of a fresh chicken breast, although still raw, is accommodated in the shell 1.

The shell according to FIG. 1 may have dimensions of 20 cm×13.5 cm, for example, including a peripheral edge 1 cm wide. The height of the shell may be 4 cm or 6 cm, for example. The stability and rigidity of the shell can be further increased to advantage through pleating of the side walls and/or by a slightly indented bottom in the central area.

Figure 2:
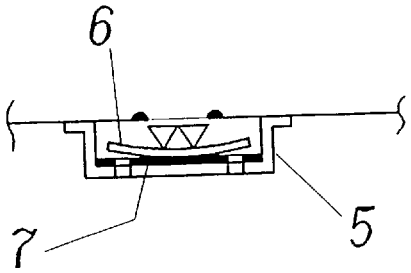
FIG. 2: an enlarged detail of the valve from FIG. 1.

Valve 5 is shown in FIG. 1 in a closed state, with membrane 6 resting on the sealing face 7. As soon as an excess pressure prevails inside the shell, membrane 6 is lifted up from sealing face 7, as illustrated in FIG. 2. A medium can then flow through the valve in the direction from inside to outside. In the opposite direction, i.e., when there is an excess pressure on the outside or a vacuum on the inside, the valve cannot open. This prevents outside air, soil and the like from entering the package shell. The valve preferably opens at an excess pressure of 3±1 mbar in the shell, and it closes again automatically when the internal excess pressure has dropped to approx. 0.5 mbar. However, a valve which opens only at a pressure of 10 mbar or higher could also be used. The valve opening itself is relatively small, amounting to only approximately 1 $mm^2$. Therefore, it has a relatively great flow resistance.

Because of the design described above, the package according to FIG. 1 can be used directly as a retail package and/or shipping package, preferably being shipped and sold under refrigeration to keep the contents fresh. Normal cooling to a conventional refrigerator temperature is fully adequate. However, deep freezing would also be conceivable and possible.

The package from FIG. 1 can be used for cooking the food 8 from a raw state, in particular without having to cut the package open, or for regenerating a food from a precooked state in a microwave oven. The package is preferably provided with instructions for use specifically intended for the contents of the package, specifying, for example, the heating power of the microwave oven and the required cooking time.

Due to the heating, some of the moisture contained in food 8 evaporates, increasing the pressure in the package. Although valve 5 then opens more or less immediately, the resulting steam cannot escape from the package at the same rate as it is formed by heating in the microwave oven (with a proper oven setting) because of the above-mentioned relatively high flow resistance of the valve opening. Therefore, a steam situation where the temperature rises to more than 100° C. and the pressure rises above the ambient pressure develops in the package. This also causes the package to expand. This steam situation is desired, because cooking of raw foods with an inherent water content, such as chicken breast 8 in the present example, takes place rapidly and gently within only a few minutes under such conditions. The valve 5 has the function of reducing or limiting the vacuum in the package.

Valve 5 and in particular membrane 6 are designed so that the latter changes under the effect of the high temperature in particular during the steam buildup phase so that the valve cannot close. At least closing of the valve is suppressed immediately after heating until the food reaches a temperature suitable for eating.

After the heating phase, i.e., after the period of time set on the microwave oven timer, when no more new steam is being generated in significant amounts, the excess pressure in the package is released through valve 5. It is advantageous here that the valve 5 cannot close immediately or at all, so that the excess pressure is not only completely reduced but also no vacuum can develop in the package after that. The package inflated by the excess pressure during the steam buildup phase can thus largely assume its original shape again at rest. It can also be opened safely to remove the cooked food because essentially ambient pressure prevails in it.

When using a WICOVALVE valve from Wipf, the desired change in valve properties during heating can be achieved, for example, through the use of a plastic material for the membrane which undergoes deformation at a temperature above a certain temperature, so then the membrane cannot close properly.

In particular, 50 μm shrink-PET film with a deformation temperature between 60° C. and 70° C. and a very marked degree of deformation is a suitable material for the membrane. A round starting shape is shrunk to a definite oval shape under the influence of heat. Another suitable material is 50 μm PAN film (PAN=polyacrylonitrile) with a deformation temperature of approximately 80° C., but with somewhat less pronounced shrinkage properties. With both these materials, the deformation occurs after heating for only approximately two minutes in a 700 Watt microwave oven, but the cooking process usually takes more than three minutes. Both times vary with the weight of the food in the package.

Another essentially suitable material is 50 μm polypropylene, although this is deformed essentially by bending only at temperatures above approximately 160° C. Membrane 5 would thus assume a bent shape, for example, as illustrated in FIG. 2, and would then more or less retain that shape. However, a longer period of time is needed for the deformation process with this material, approaching the total amount of time required for the entire heating process.

EXAMPLES OF RECIPES

A few examples of recipes with their respective microwave heating powers and cooking times are given below. The individual recipes were tested with packages according to this invention, as illustrated in FIG. 1, said packages being equipped with a WICOVALVE valve from Wipf (see above), which did not close after the steam buildup phase. To this extent, there was no deformation of the package "into the negative" in any of these examples.

| Recipe | Time, power |
|---|---|
| Chicken breast, raw, 100 g<br>Mixture of raw julienne vegetables, 30 g<br>Seasoning emulsion, 5 g | 3:30 minutes at 750 watts |
| Salmon fillet, raw, 100 g<br>Mixture of raw julienne vegetables, 30 g<br>Seasoning emulsion, 5 g | 3 minutes at 750 watts |
| Mixed vegetables, i.e., raw and coarsely cut carrots, zucchini, paprika, leeks, cabbage and broccoli, 200 g<br>Emulsified seasonings, 16 g<br>"Royal" chicken breast, raw on a mixture of raw vegetables (carrots, zucchini, paprika, leeks, cabbage, broccoli) | 3:30 minutes at 750 watts |
| 265 g<br>300 g<br>300 g<br>Pot-au-feu [stew] with raw, cut up chicken breast, fresh vegetables and some chicken broth | 3:30 minutes at 750 watts<br>4:30 minutes at 750 watts<br>4:30 minutes at 600 watts |
| 275 g–290 g<br>275 g<br>Chicken breast, grilled but uncooked at the center, on partially cooked ratatouille | 4:30 minutes at 750 watts<br>5:00 minutes at 600 watts |
| 250 g–275 g<br>275 g<br>Chicken wing, raw, grilling seasonings | 4:00 minutes at 750 watts<br>4:30 minutes at 600 watts |
| 150–167 g<br>150 g<br>Chicken roulade: chicken breast raw, wrapped in Italian ham such as pancetta and coated with the emulsified seasoning | 3:30 minutes at 750 watts<br>4:00 minutes at 600 watts |
| 171 g–190 g<br>190 g<br>Prepared dishes ("Indian style") using raw chicken breast, paprika and onions in a curry mixture | 3:30 minutes at 750 watts<br>4:00 minutes at 600 watts |
| 190 g<br>190 g<br>230 g<br>Raw chicken neck, used in grilling seasonings with prefried, seasoned potato cuts or wedges | 3:00 minutes at 750 watts<br>3:30 minutes at 600 watts<br>3:30 minutes at 750 watts |
| 251 g<br>Salmon fillet, raw, 100 g<br>Mixture of raw vegetable julienne, 30 g<br>Emulsified seasoning, 5 g | 3:30 minutes at 750 watts |
| 170 g–185 g<br>220 g<br>220 g<br>Royal fillet of cod on lightly cooked ratatouille vegetables with a Provencal herb seasoning mix | 3:00 minutes at 750 watts<br>3:30 minutes at 750 watts<br>4:00 minutes at 600 watts |
| 250 g–288 g<br>250 g<br>Salmon, natural, raw, coated with an emulsified seasoning mix (precoated) | 3:00 minutes at 750 watts<br>3:30 minutes at 600 watts |
| 170 g–180 g<br>170 g<br>Prawn, calimari and pieces of cod with olives and a mixture of raw vegetables, Brunoise cut in olive oil and herbs | 3:00 minutes at 750 watts<br>3:30 minutes at 600 watts |
| 267 g–290 g<br>267 g–290 g<br>Royal cod filet on a mixture of raw vegetables (carrots, zucchini, paprika, leeks, cabbage, broccoli) | 2:00 minutes at 750 watts<br>2:30 minutes at 600 watts |
| 240 g–250 g<br>240 g–250 g<br>Prepared dishes containing pieces of red salmon, paprika, leeks and onions, coated with an emulsified seasoning | 3:00 minutes at 75 watts<br>3:30 minutes at 600 waters |
| 120 g<br>160 g<br>160 g | 1:15 minutes at 750 watts<br>1:30 minutes at 750 watts<br>2:00 minutes at 600 watts |

The package and the method according to this invention are also suitable for preparing baked goods such as cakes or the like, with the preparation time starting from raw dough being only a few minutes in a microwave oven. For example, three minutes at an oven power of 700 watts would be possible, but the preparation time would of course vary with the amount of food in the package and the microwave power. A recipe is given below that has proven especially suitable for preparing a stirred batter cake in a package according to the present invention.

| No. | Raw materials | Weight (g) | % |
|---|---|---|---|
| 1 | Sugar | 110 | 23.08 |
| 2 | Butter | 60 | 12.59 |
| 3 | Eg | 57 | 11.96 |
| 4 | Flour | 120 | 25.18 |
| 5 | Vanilla sugar | 6 | 1.26 |
| 6 | Baking powder | 2 | 0.42 |
| 7 | Milk | 100 | 20.99 |
| 8 | Best Foods ingredient no. 3422 cold swelling base | 10 | 2.10 |
| 9 | Salt | 0.5 | 0.10 |
| 10 | Hamulsion MFC | 8 | 1.68 |
| 11 | Apple pectin (Dr. Oetkar) | 3 | 0.63 |
| | Total | 476.5 | 100 |

The preceding recipe is to be understood as a basic recipe that can be varied, improved and refined by adding different ingredients. In particular, cocoa powder, flavorings such as lemon flavoring and/or fruit may be added. Essentially, even yeast cakes and breads, baked snacks, sweet and salty, and perhaps even soft bread such as toast would also be possible.

The dough according to the recipe given above is relatively solid when refrigerated (at refrigeration temperature), so it does not flow freely in the package. Addition of the cold swelling starch system with a neutral taste (ingredient no. 8) contributes to a good, lasting homogeneity. This also prevents separation of the components in the raw and baked state. The starch system also binds the liquid used for ingredient no. 7 in the raw stored state. As an expanding agent, the baking powder as ingredient no. 6 supports rapid rising of the dough while heating in the microwave oven, with a steam buildup situation occurring again. The hydrocolloid mixture produced by the company G. C. Hahn from Lubeck as ingredient no. 10 serves to prevent the dough from collapsing like a souffle after the very brief "steam baking process." Finally, the binder apple pectin according to no. 11 serves to bind the moisture present in the dough during heating (but not when cold), keep it mostly in the dough and prevent large volumes of steam from forming during the "steam baking" in the package.

The cake produced with the recipe given above is light and has a fine crumb. In comparison with that, traditional finished stirred batters such as those commercially available at this time develop severe bubbling during "steam baking" and the resulting surface of the finished cake is coarse and porous.

What "steam baking" fundamentally cannot accomplish is browning or development of a crust at the surface of the baked goods. However, if the baked goods are removed from the package immediately after heating, the surface will dry out relatively rapidly, and a slightly crunchy surface will develop quickly. Immediate removal from the package is also advantageous inasmuch as the baked goods can then be removed easily and will not stick to the package.

The free space above the raw dough is especially important in "steam baking"; it must be large enough to accommodate the expected rising of the dough.

What is claimed is:

1. A shipping or retail package for food intended to be heated in the package and consumed while hot, comprising:

a container made of a material suitable for use in a microwave oven, whereby, taking into account the water content of the food, enough liquid is present in the package for the food to be heated in a developing steam atmosphere in the package when heated in a microwave oven; and a one-way valve in a wall of said container, said valve opening automatically to the outside at an internal excess pressure, then closing again automatically after the pressure drops, thus limiting or reducing the vapor pressure developing in the package when heated rapidly in a microwave oven, wherein said valve having a membrane that may automatically open and automatically close until said membrane deforms during heating of said package, thereby causing said valve to remain open.

2. The package according to claim 1, wherein the membrane is deformed by the effect of the temperature reached in heating the food or by a resulting excess pressure in the package.

3. The package according to claim 2, wherein the deformation of the membrane begins at a temperature above approximately 50° C.

4. The package according to one of claims 1 through 3, wherein the valve is suitable for allowing the steam generated in the package during rapid heating in a microwave oven per unit of time to escape from the package only comparatively slowly because of its flow resistance.

5. The package according to one of claims 1 through 3, wherein the valve opens at a slight excess pressure of less than approximately 5 mbar.

6. The package according to one of claims 1 through 3, wherein the food in the package is at least partially raw.

7. The package according to one of claims 1 through 3, wherein said container is formed by a shell of a plastic material with thin walls provided with a cover film.

8. The package according to one of claims 1 through 3, wherein the food has a water content of at least 30%.

9. The package according to one of claims 1 through 3, wherein the food is preseasoned ready to eat.

10. The package according to one of claims 1 through 3, characterized in that the food is a prepared dough.

11. A method of heating a food product by microwave energy, comprising the steps of:

providing the food product having a water content that enables steam pressure to develop during heating by microwave energy;

disposing and sealing said food product in a microwavable shipping and/or retail package, said package comprising a container with a one-way valve mounted in a wall of said container, said valve having a flexible membrane;

heating said package by microwave energy, causing excess pressure to develop in said container, whereby said valve automatically opens and vents pressure to the outside and said valve automatically closes when the pressure drops, wherein said valve may automatically open and automatically close until said membrane deforms, thereby causing said valve to remain open.

12. The method of claim 11, wherein said food product is at least partially raw.

13. The method of claim 11, wherein the step of heating said package by microwave energy, causing steam pressure to develop in said container, cooks said food product.

14. The method of claim 11, wherein said membrane is deformed by the effect of the temperature reached in heating said food product.

15. The method of claim 14, wherein said membrane deforms at a temperature above approximately 50° C.

16. The method of claim 11, wherein said membrane is deformed by the excess pressure in said container.

17. A shipping or retail package for food intended to be heated in the package and consumed while hot, comprising:

a container made of a material suitable for use in a microwave oven, whereby, taking into account the water content of the food, enough liquid is present in the package for the food to be heated in a developing steam atmosphere in the package when heated in a microwave oven; and a one-way valve in a wall of said container, said valve opening automatically to the outside at an internal excess pressure, then closing again automatically after the pressure drops, thus limiting or reducing the vapor pressure developing in the package when heated rapidly in a microwave oven, wherein said valve having a valve member that is permanently modified during heating of said package, thereby causing said valve to remain open.

18. The package of claim 17, wherein the modification of the valve member during heating of said package includes the valve member being deformed during heating of said package.

19. The package of claim 17, wherein the valve member is a valve body.

20. The package of claim 17, wherein the valve member is a valve face.

21. The package of claim 17, wherein the valve member is an oil.

* * * * *